US005647217A

United States Patent [19]

Penswick et al.

[11] Patent Number: 5,647,217

[45] Date of Patent: Jul. 15, 1997

[54] STIRLING CYCLE CRYOGENIC COOLER

[75] Inventors: Laurence B. Penswick, Richland, Wash.; Ronald E. Neely, Aloha, Oreg.

[73] Assignee: Stirling Technology Company, Kennewick, Wash.

[21] Appl. No.: 585,038

[22] Filed: Jan. 11, 1996

[51] Int. Cl.[6] ..... F25B 9/00

[52] U.S. Cl. ..... 62/6; 60/520

[58] Field of Search ..... 62/6; 60/520, 517

[56] References Cited

U.S. PATENT DOCUMENTS

| | | | |
|---|---|---|---|
| 4,259,844 | 4/1981 | Sarcia et al. | 62/6 |
| 4,353,683 | 10/1982 | Clark | 417/379 |
| 4,389,849 | 6/1983 | Gasser et al. | 62/6 |
| 4,391,103 | 7/1983 | Sarcia | 62/6 |
| 4,397,156 | 8/1983 | Heisig et al. | 62/6 |
| 4,418,533 | 12/1983 | Folsom | 60/520 |
| 4,475,345 | 10/1984 | Forth et al. | 62/6 |
| 4,481,777 | 11/1984 | Sarcia | 62/6 |
| 4,522,033 | 6/1985 | Jensen | 62/6 |
| 4,532,766 | 8/1985 | White et al. | 60/517 |
| 4,543,792 | 10/1985 | Bertsch | 62/6 |
| 4,545,209 | 10/1985 | Young | 62/6 |
| 4,578,956 | 4/1986 | Young | 62/6 |
| 4,792,346 | 12/1988 | Sarcia | 62/6 |
| 4,819,439 | 4/1989 | Higham | 62/6 |
| 5,040,372 | 8/1991 | Higham | 62/6 |

*Primary Examiner*—William Doerrler

*Attorney, Agent, or Firm*—Wells, St. John, Roberts, Gregory & Matkin, P.S.

[57] ABSTRACT

A displacer assembly for use with a thermal regenerative machine has a housing configured to receive a displacer therein. The displacer has a drive area formed by a rod portion of the displacer that extends through a hole in the housing to form a clearance seal therebetween. The housing and displacer form a sub-assembly that can be pre-assembled to provide a clearance seal prior to assembly with a linear drive motor. Another feature is provided by a fluid flow path extending centrally of the displacer rod, and in part along an outer peripheral surface of the rod adjacent a heat rejection region of the housing. Heat transference there along provides for a more efficient stirling thermodynamic cycle in response thereto.

39 Claims, 5 Drawing Sheets

STIRLING CYCLE CRYOGENIC COOLER

TECHNICAL FIELD

This invention relates to internally mounted displacer assemblies for use in power conversion machinery, such as a compressor, an engine, a heat pump, or a Stirling cycle cryogenic cooler.

BACKGROUND OF THE INVENTION

Axially reciprocating displacers in power conversion machinery, such as Stirling cycle machines, incorporate clearance seals between portions of a reciprocating displacer and a housing. The displacer forms a movable piston within the housing. Movement of the displacer transfers working fluid back and forth between a compression space, having a high temperature space, and an expansion space, having a low temperature space. In one case, an end portion of a reciprocating displacer forms a drive area in fluid contact with the compression space. The displacer end portion slidably extends through a bore in the housing in fluid communication with a compression space of a linear drive motor. The drive motor has a driving piston that operates on working gas in the compression chamber. The working gas then directly works on the displacer to produce motion. Hence, the driving piston and displacer form a free piston machine, cooperation solely by action of the working fluid. A clearance seal is typically provided between the displacer end portion and the housing bore by maintaining an accurate reciprocating motion of the displacer and by providing an accurate relative sizing of the bore in the housing with the working piston and displacer end portion.

Techniques previously identified for achieving clearance seals in power conversion machinery include 1) precision machining of a bore with respect to a reciprocating displacer or piston member, 2) flexural bearings used to accurately position a reciprocating member with respect to a clearance seal, and 3) gas bearing supports/seals.

The present invention arose in part from an effort to improve the implementation of clearance seals in power conversion machinery. The general advantages of clearance seals include the following: improved efficiency resulting from elimination of sliding or rubbing surfaces in contact with one another; higher reliability resulting from elimination of contact wear that may produce detrimental seal leakage; extended life resulting from break-down of sliding or rubbing components leading to degradation of seals therebetween; lower cost resulting from elimination of separate sealing components that also add manufacturing steps during assembly; and less frictional wear and less generation of unwanted debris resulting from elimination of rubbing contact during start up and shut down; and reduced complexity by elimination of additional sealing components.

Coaxial non-rotating linear reciprocating members in power conversion machinery, such as Stirling Cycle Machines, incorporate gas flow paths to connect the compression space with the displacer assembly in the machine. The path allows working gas to be transferred back and forth between hot and cold working spaces; namely, the compression and expansion spaces. Particularly for small Stirling Cycle Coolers, a regenerator is placed in the flow path between the hot and cold spaces. In one version, the regenerator is carried by the moving displacer at a location remote from the compression space. A fluid flow path transfers working fluid between the compression space and expansion space, through the regenerator. The displacer reciprocates within a cylinder between the compression and expansion spaces, transferring working fluid in response to changes in the thermodynamic state of the working fluid. In response to the motion, the regenerator and flow path transfer fluid between the hot and cold ends provided by the compression and expansion spaces. A working gas is cooled as it flows through the regenerator, after which it is further cooled by expansion in the expansion chamber along a cold end of the displacer. Depending on the direction of fluid flow, the regenerator acts as a heat exchanger and a heat store. The resulting cooled working fluid is then able to better absorb heat at the cold end of the machine.

Small Stirling Cycle Coolers can be used for a number of cooling operations. One desirable application involves a cooler having a relatively small cold head configured to facilitate placement adjacent a sensor. For example, when detecting certain phenomena with a sensor, the sensor can be subjected to harsh thermal environments. Utilization of such a cooler enables placement of a sensor directly on the cold head of the cooler. Alternatively, a cryostat can be formed by placing the cold head in liquid nitrogen gas, in which the sensor is also positioned. Additionally, the cold head of such a cooler can be utilized to cool switching electronics, while maintaining relatively low noise from the device. Further alternative applications involve utilization of such a cooler to cool charge coupled devices, or even computer central processing units (CPU's).

One previously utilized technique for connecting a compression space with a regenerator and an expansion chamber involves providing a gas flow path by machining the path into the surrounding structure or body of the Stirling Cooler. Alternatively, a separate tube can be used to route the flow path between the compression and expansion chambers. Both of these approaches can complicate the mechanical complexity of the machine. Additionally, both approaches can result in high flow losses occurring along the flow path.

The present invention also arose from an effort to develop a thermodynamically improved flow path between the compression space and the displacer assembly. Improvements in maintaining a relatively small flow resistance while enhancing thermodynamic transference is just one of several benefits provided by the following implementations of the present invention. Another benefit provided by the following implementations is a clearance seal construction that is more easily and cost effectively implemented, greatly reducing any precision and accuracy requirements when machining and assembling components of the invention.

BRIEF DESCRIPTION OF THE DRAWINGS

Preferred embodiments of the invention are described below with reference to the following accompanying drawings.

FIG. 4 is center line sectional view of a cryogenic cooler assembly of this invention;

FIG. 5 is a centerline sectional view of the displacer assembly of FIG. 4.

DETAILED DESCRIPTION

This disclosure of the invention is submitted in furtherance of the constitutional purposes of the U.S. Patent Laws "to promote the progress of science and useful arts" (Article 1, Section 8).

The basic elements of the invention are described with reference to conventional components of an integral, free-piston Stirling Cycle Refrigerator. The features disclosed in this invention can also be applied to other non-rotating linear reciprocating members used within power conversion machinery, such as a split Stirling refrigerator, any configuration of Stirling engines, a fluid compressor, a pump, a linear alternator or generator, and other thermodynamic cycle devices which require linear reciprocation of a displacer and/or piston, such as the expander portion of a Gifford McMahon cooling machine.

Figure 1:
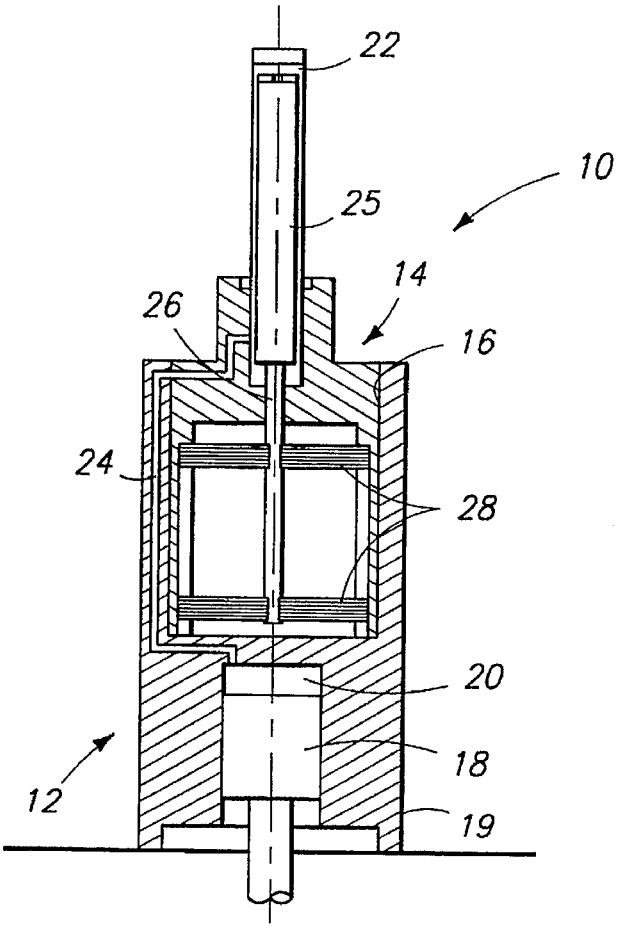
Fig 1 RELATED ART
FIG. 1 is a schematic cross-sectional view of a related art Stirling Cycle cryogenic cooler construction.

FIG. 1 schematically illustrates one related art construction for a thermal regenerative machine, or cryogenic cooler 10. The related art device depicted in FIG. 1 has been illustrated in an effort to describe earlier conceived and less preferred devices preceding the device of FIGS. 3–6. Machine 10 has certain features of applicants' invention, along with certain other above-mentioned prior art features. Machine 10 is formed by two separate assemblies; namely, a linear drive motor 12 and a displacer assembly 14 which is mounted in a receiving hole 16 of motor 12. A piston 18 reciprocates within a housing 19 of motor 12 to act on a compression chamber 20. A gaseous working fluid contained therein is acted upon by the piston 18 where it is transferred between compression chamber 20 and an expansion chamber 22 by way of a fluid flow path 24. A regenerator 25 is placed in fluid flow path 24, in fluid flow communication between compression chamber 20 and expansion chamber 22 in order to optimize thermodynamic performance there along. A displacer 26 carries regenerator 25 within assembly 14 by way of a pair of stacked flat spiral springs 28. Springs 28 guide the displacer in axial reciprocation within assembly 14. Additionally, springs 28 produce a counteracting force that is counterbalanced by working fluid moving within expansion chamber 22 in conjunction with movement of displacer 26 therein.

Furthermore, the stiffness of springs 28 combined with the moving mass of displacer 26 and the action of working fluid resulting from motion of piston 18 cooperate to define a tunable system. By modifying the stiffness of springs 28, or by adding additional springs, the system can be tuned since its overall spring stiffness is changed as a result thereof.

In operation, piston 18 imparts expansion and contraction of gaseous working fluid particularly along expansion chamber 22 as displacer 26 reciprocates within housing 19 of assembly 14. Expansion of gases in chamber 22 produces cooling of a portion of the working fluid contained therein. However, the device of FIG. 1 includes a lesser-preferred prior-art implementation of fluid flow path 24 for interconnecting compression chamber 20 and expansion chamber 22. Namely, fluid flow path 24 is routed through housing 19, away from displacer 26. Such a fluid flow path construction is difficult to form within housing 19 of motor 12, and through assembly 14. Additionally, flow path 24 forms an indirect route for working gases, which has a significantly increased flow resistance. Furthermore, it is more expensive to produce.

Figure 2:
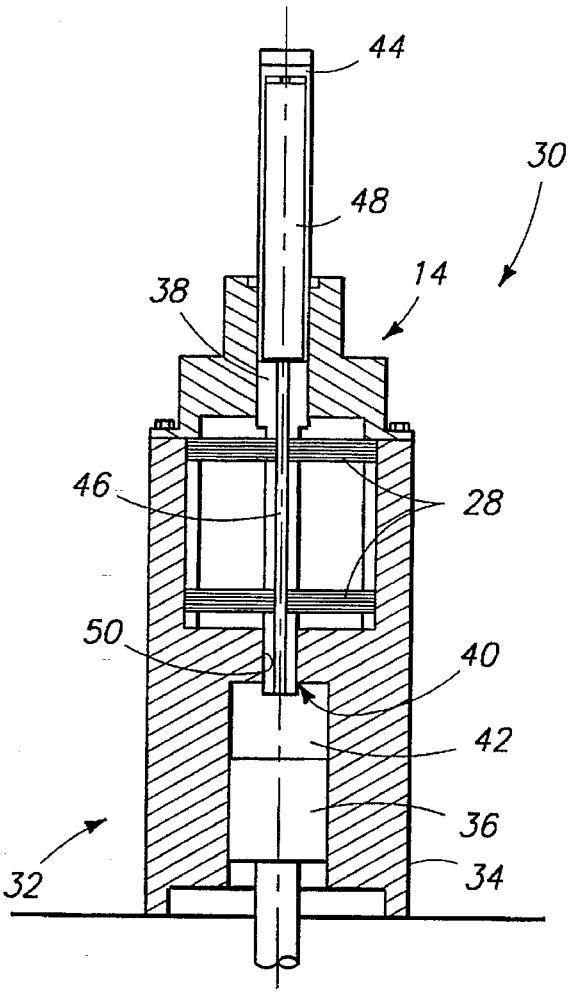
Fig 2 RELATED ART
FIG. 2 is a schematic cross-sectional view of a second related art Stirling Cycle cryogenic cooler construction.

FIG. 2 schematically illustrates another related art implementation for a thermal regenerative machine, or cryogenic cooler 30. The related art device depicted in FIG. 2 has been illustrated in an effort to describe earlier conceived (by applicants) and less preferred devices preceding the device of FIGS. 3–6. Similar to machine 10 of FIG. 1, machine 30 has certain features of applicants' invention, along with certain other above-mentioned prior art features. A linear drive motor 32 has a common housing 34 configured to house piston 36 and displacer 38 directly therein. The housing 34 forms an integral clearance seal 40 directly between the housing and the displacer. The provision of an integral clearance seal within such a common housing is already known in the art. However, clearance seal 40 allows for direct routing of gaseous working fluid between a compression chamber 42 and an expansion chamber 44 by way of a fluid flow path 46. Path 46 is integrally and centrally formed in the displacer. A regenerator 48 is also provided in the displacer within the central fluid flow path 46 for enhancing thermodynamic performance there through.

To ensure realization of seal 40, stacks of flat spiral springs 28 are used to accurately carry displacer 38 centered within a bore 50, creating clearance seal 40. However, with this construction it becomes necessary to very accurately tolerance displacer mounting features; namely, dimensions inside housing 34, sizing of spring 28, construction of displacer 38, as well as accurate positioning of bore 50 in housing 34 in order to realize a close fit tolerance clearance seal 40. Therefore, this implementation results in a relatively costly and complex construction.

Figure 3:
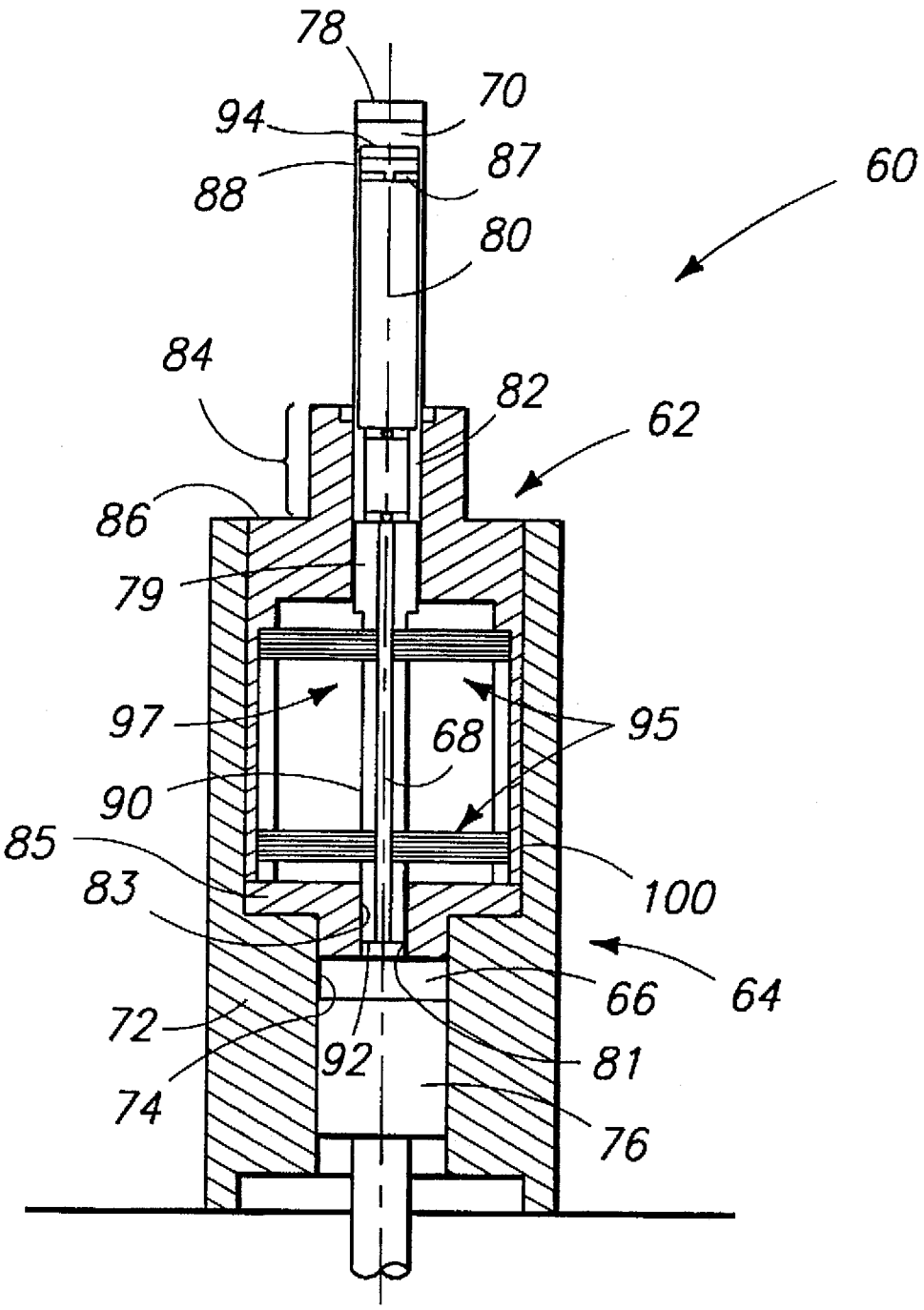
FIG. 3 is a schematic cross-sectional view of one embodiment of the invention.
Figure 3:
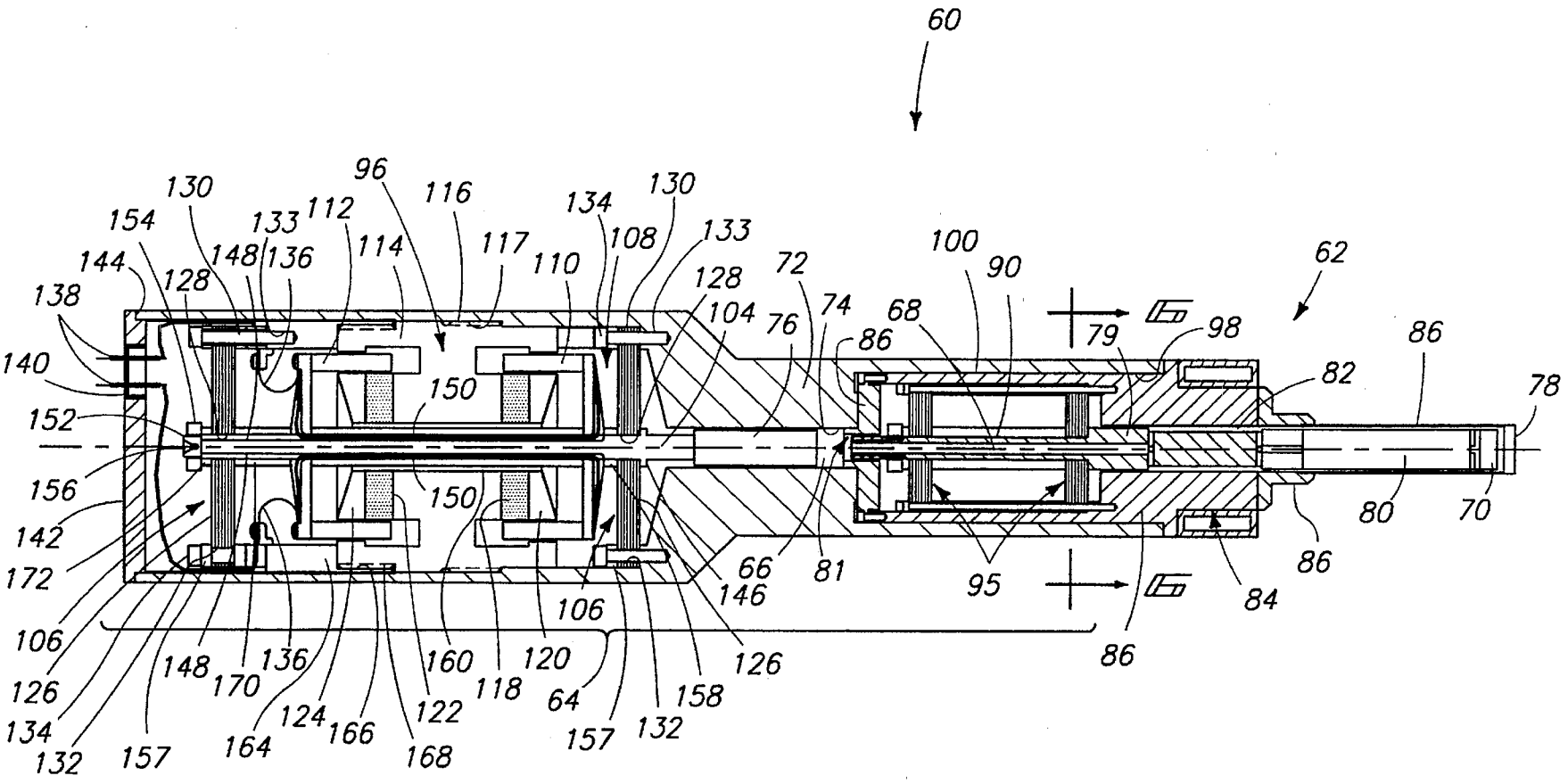
Figure 11:
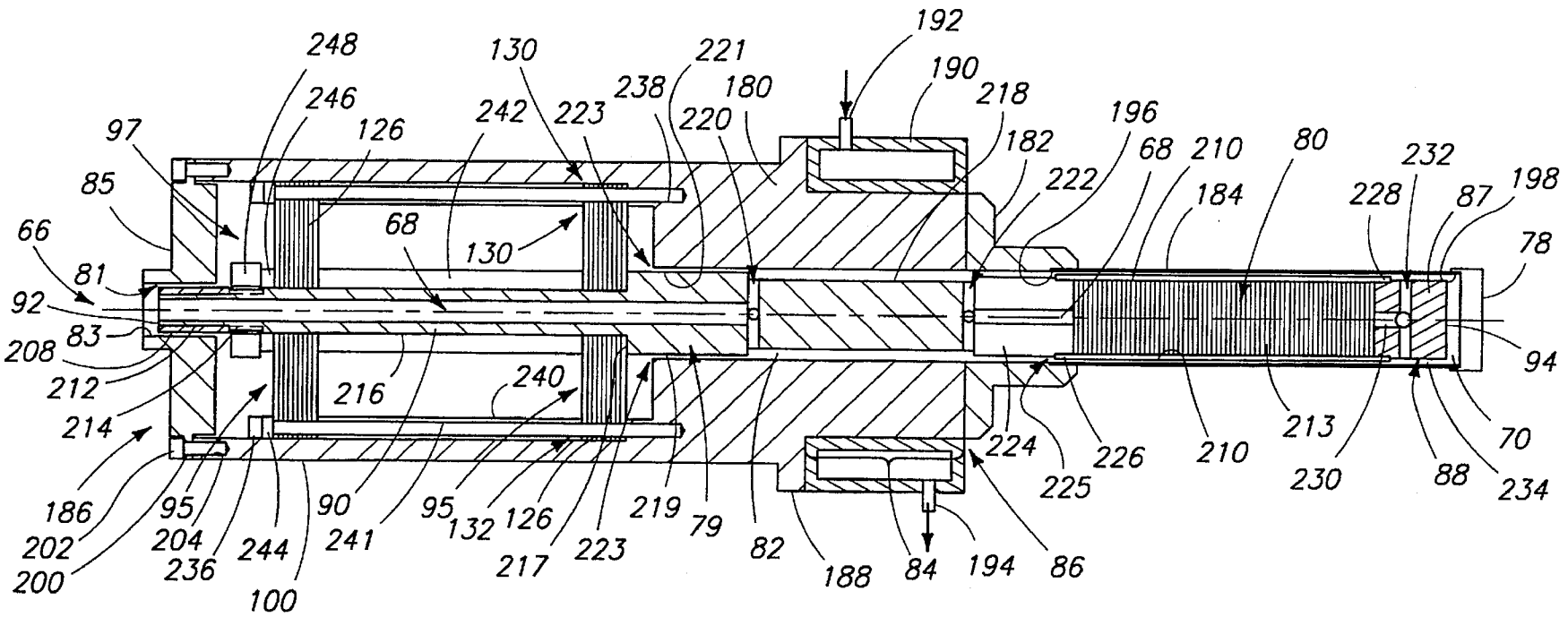
Figure 6:
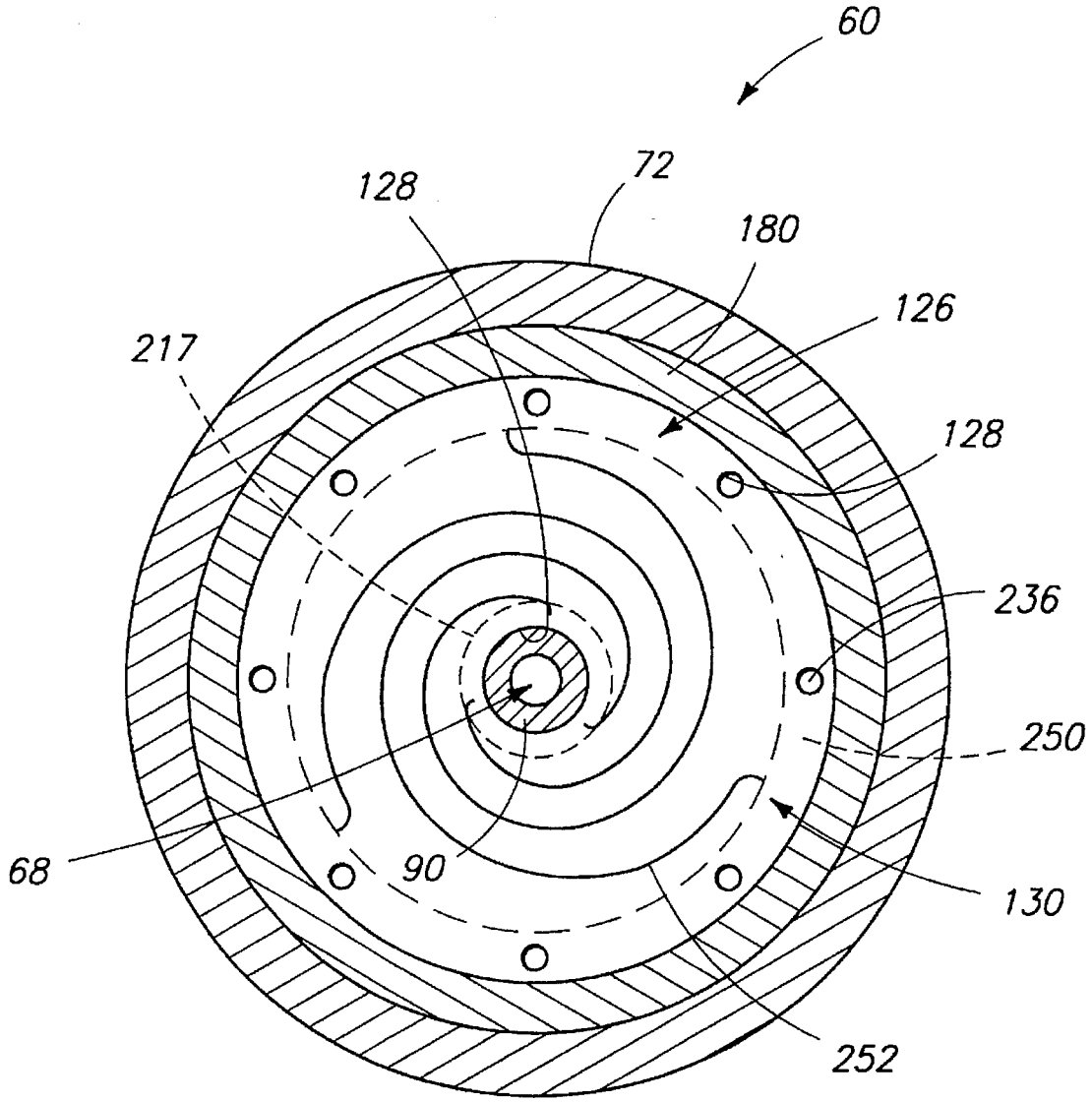
FIG. 6 is cross sectional view taken generally along line 6—6 of FIG. 4.

A preferred implementation has been realized according to the device depicted schematically in FIG. 3, and in further detail in FIGS. 4 through 6, in order to realize certain of the benefits provided by the devices of FIGS. 1 and 2. Namely, benefits of the displacer and motor sub-assembly construction depicted in FIG. 1 are desirable, without resorting to the flow path 24. Furthermore, the benefits of the clearance seal 40 depicted in FIG. 2 are desirable, without having to carefully tolerance machine components.

PREFERRED EMBODIMENT

FIG. 3 schematically illustrates a construction for a Stirling Cycle Cryogenic Cooler 60 of this invention. Cooler 60 is formed by assembling together a displacer assembly 62 and a separate linear drive motor, or compressor 64. The cryogenic cooler 60 is a thermal regenerative machine configured in operation to house a gaseous working fluid. Linear drive motor 64 alternatively compresses and expands working fluid within a compression chamber 66 in fluid communication via a fluid flow path 68 with an expansion chamber 70. A portion of the working fluid within expansion chamber 70 cools an end of the cryogenic cooler 60 each time it is expanded.

Linear drive motor 64 has a motor housing 72 with a bore 74 configured to receive a piston 76, as shown in FIG. 3. The piston 76 is driven in axial reciprocation within bore 74 by way of an electric motor (not shown). Piston 76 acts on, or drives the working fluid within compression chamber 66, fluid flow path 68, and expansion chamber 70 pursuant to a Stirling thermodynamic refrigeration cycle in order to cool a cold head 78 on the end of cooler 60. In order to enhance thermodynamic efficiency of cooler 60, a regenerator 80 is also provided in-line and in fluid communication with fluid flow path 68, adjacent to expansion chamber 70.

As shown in FIG. 3, fluid flow path 68 is provided generally along a central portion of a displacer 79 between regenerator 80 and compression chamber 66. Additionally, a portion of path 68 is diverted to a circumferential portion 82 provided along an outer peripheral surface 84 of displacer 79. Portion 82 is formed in a heat rejection region 84 of a displacer housing 86 of displacer assembly 62. Working fluid passes through regenerator 80 by way of an end cap 87 configured to provide another cylindrical cooling region 88 contiguous with expansion chamber 70. The region surrounding expansion chamber 70, including cold head 78, defines another heat rejection region along housing 86.

Housing 86 of displacer assembly 62 and motor housing 72 of linear drive motor 64, when joined together in assembly form a common housing for retaining the gaseous working fluid therein. As shown in FIG. 3, displacer 79 is substantially formed by a displacer rod 90, regenerator 80, and end cap 87. Opposite ends of displacer 79 form a drive area 92 and an expansion area 94, respectively. Areas 92 and 94 are acted on by pressure differentials in the working fluid, as are other areas within the displacer assembly, causing the displacer to reciprocate therein. The displacer 79 is supported for reciprocation by a pair of internally mounted flexure bearing assemblies 95. The pair of assemblies 95 are constructed and arranged to support displacer 79 within a chamber 97 formed within housing 86.

An end plate 85 mounted at one end of displacer assembly 62 provides a clearance seal 81 between compression piston 92 and housing 86. End plate 85 is mounted to housing 86 after displacer 79 has been mounted in the housing. Flexure bearing assemblies 95 guide displacer 79 in accurate axial reciprocation therein, enabling provision of clearance seal 81 there along. Laterally adjustable mounting features are also provided between end plate 85 and housing 86, enabling alignment therebetween to achieve clearance seal 81 during final sub-assembly. In this manner, any need for critical alignment between housing 86, displacer 79 and associated components, and end plate 85 is eliminated. Therefore, the aforementioned construction enables realization of an accurate and precise clearance seal 81 without having to resort to a costly and difficult precision construction for each component, and the overall assembly.

As shown in greater detail in FIGS. 4 and 5, Stirling cycle cryogenic cooler 60 is constructed by mating together a pair of preassembled components; namely, displacer assembly 62 and motor assembly 64. Motor assembly 64 operates as a working fluid compressor, wherein piston 76 is driven by an electric motor 96 to form a compressor within motor housing 72. Piston 76 and motor 96 are constructed and arranged within motor housing 72 in order to produce working fluid pressure pulses within compression chamber 66. Displacer 79 of assembly 62 reciprocates within chamber 97 in response to fluid pressure differential in the working fluid. The hot and cold spaces at each end of cooler 60 also impart changes to pressure of the working fluid.

A. Motor Assembly

As shown in FIG. 4, working fluid motor assembly 64 is formed by housing 72, electric motor 96, piston 76, and a receiving cavity 98. Piston 76 is carried for reciprocation in housing 72. Additionally, cavity 98 is constructed and arranged to receive a mating portion 100 of displacer assembly 62. In assembly, mating portion 100 of assembly 62 is formed from a housing portion 86 of assembly 62. Mating portion 100 is constructed and arranged in assembly to be received in cavity 98. With such a construction, motor assembly 64 forms a linear drive motor having driving piston 76 movable in fluid communication with compression chamber 66 for axial reciprocation within motor housing 72.

As shown in FIG. 4, motor assembly 64 forms a separate compressor sub-assembly that houses electric motor 96 and working piston 76 in aligned and accurate reciprocating relation within integral piston bore 74. In response to application of electricity to motor 96, piston 76 moves in reciprocation within bore 74, creating a linear compressor. A compressor shaft 104 carries piston 76 by way of a pair of internally mounted flexure bearing assemblies 106. The pair of assemblies 106 cooperate to mount shaft 104 within a chamber 108 formed by the housing. Additionally, an inner and an outer moving coil 110 and 112 are mounted to compressor shaft 104 for driving piston 76. Electric current is applied to coils 110 and 112 which magnetically cooperates with motor housing 114 to reciprocate shaft 104. Motor housing 114 is rigidly secured by threads 116 that engage with mating threads 117 formed along an inner surface of housing 72. An inner end of motor housing 114 is formed by a magnet 118 and a magnetic steel 120. Similarly, an outer end of housing 72 is formed by a magnet 122 and a magnetic steel 124. Application of alternating current to inner and outer moving coils 110 and 112 produces a well known reciprocation of compressor shaft 104 and piston 76. The resulting assembly is driven by polarity changes induced in each coil relative to each magnet.

A pair of flexible electrical leads, or conductive flexures 136 connect the inner and outer moving coils 110 and 112 to electrical wires 138. Wires 138 are mounted in relative fixed relation within the housing 72. Leads 136 are constructed from beryllium copper alloy configured in the shape of flat ribbons of material. Additionally, wires 138 pass into housing 72 through an end cap 140. End cap 140 has a steel outer casing that houses a ceramic or plastic body for receiving wires 138 in sealed through-passage into housing 72. Preferably, the steel outer casing on end cap 140 is welded directly to an end plate 142 of housing 72. Preferably, end plate 142 has a lip edge 144 that seats end plate 142 to housing 72. A circumferential weld is applied along the lip edge to join plate 142 to housing 72 after assembly. The end cap 140 and end plate 142 pursuant to this construction completely seal the internal components within housing 172.

As shown in FIG. 4, working cavities within cooler 60 are filled with a thermodynamically suitable working gas once the displacer 62 and motor 64 are assembled together, typically by welding them together. For example, housing chamber 108 and displacer chamber 97 can be internally filled and pressurized with hydrogen, preferably in a range of between 100 to 700 psi. Alternatively, helium gas can be utilized to fill the chambers 97 and 108, depending on the type of operation intended for cooler 60. Such gases provide desirable working fluid for cooler 60. Furthermore, cooler 60 operates at high speeds, typically about 60 cycles per second. The pressure oscillations resulting therefrom tend to be sinusoidal, driving the working fluid and displacer in response thereto.

Each flexure bearing assembly 106 is constructed and arranged from at least one flat spiral spring 126. A suitable construction will be discussed with reference to FIG. 6. Such a construction of a flat spiral spring 126 is understood and is disclosed in applicant's co-pending U.S. patent application Ser. No. 08/105,156 entitled "Improved Flexure Bearing Support, with particular application to Stirling Machines, filed Jul. 30, 1993, hereafter incorporated by reference. Each flat spiral spring 126 has a central through hole 128 and a cylindrical outer periphery 130. Hole 128 facilitates mounting of spring 126 to a shaft, such as compressor shaft 104. A plurality of equally spaced apart fastener receiving holes 132 extend circumferentially along periphery 130. Preferably, a male threaded fastener 134 is received through each hole 132 of each spring 126 when stacked together.

A typical spiral spring 126 will have a diameter of 2.25 inches, a thickness of 0.02 inches, and will be formed from spring steel. The typical flexure bearing assembly 106 will have about 6 spiral springs that are nested together and secured with fasteners 134 to housing 72. As will be discussed below, assemblies 95 of displacer assembly 62 are similarly constructed, but have a reduced diameter.

As shown in FIG. 4, compressor shaft 104 has an integrally formed shoulder 146 configured to facilitate retention of the innermost bearing assembly 106. Piston 76 is formed by an innermost end portion of compressor shaft 104. A pair of radially opposed and longitudinally extending grooves 148 are provided along shaft 104 to facilitate passage of electrical wires 150 from the flexible leads 136 to the inner moving coil 110. An outer end of shaft 104 forms a threaded end portion 152 that is configured to receive a threaded nut 154. Additionally, a center drill portion 156 is formed at the outermost end of shaft 104, adjacent to threaded end portion 152. Portion 156 facilitates precision mounting of shaft 104 onto a lathe in order to machine the shaft prior to assembly.

To assemble motor assembly 64, piston 76 and shaft 104 are inserted into bore 74 of housing 72. Subsequently, a stack of flat spiral springs 126 are inserted over threaded end portion 152 of shaft 104 where they are slid into engagement with shoulder 146. A retaining ring 157 is then seated against outer periphery 130 of springs 126. Ring 157 has through holes 159 that align in assembly with holes 128 in the stacked springs 126. Subsequently, a plurality of male threaded fasteners 134 are received through holes 159 and 132 in ring 157 and springs 126, respectively. When tightened, fasteners 134 secure within threaded bores 133 to retain the resulting flexure bearing assembly 106 within housing 72.

A cylindrical spacer 158 is then installed over shaft 104 by inserting it over end portion 152 and sliding it until it engages with bearing assembly 106, according to FIG. 4. Subsequently, inner moving coil 110 is inserted over end portion 152, bringing it over shaft 104 in combination with wires 150 as they seat within grooves 148. Coil 110 is positioned to seat against cylindrical spacer 158. Subsequently, a tubular coil spacer 160 is inserted over end portion 152, bringing it over shaft 104 into engagement with inner coil 110. There after, motor housing 114 is brought over end portion 152, sliding it over shaft 104 where it is threaded into engagement with housing 72. Motor housing 114 has threads 116 formed on an outer portion there along. Likewise, complementary corresponding threads 117 are provided on an inner portion of housing 72.

Once motor housing 114 has been retained therein, outer moving coil 112 is positioned over shaft 104, and electrical wires 150 are secured to each of flexible conductive leads 136. Subsequently, a flexure support member 164 having a threaded inner face 166 is mated into engagement with a threaded outer face 168 on motor housing 114, bringing support member 164 into engagement with motor housing 114. Support member 164 provides a mounting support for the outer flexure bearing assembly 106, as well as a mounting support for flexible conductive leads 136. Subsequently, an outer tubular coil spacer 170 is received over shaft 104 until it mates in engagement with outer moving coil 112.

Thereafter, a plurality of flat spiral springs 126 are inserted over end portion 152 into engagement with spacer 170, providing outer flexure bearing assembly 106, pursuant to FIG. 4. Another retaining ring 157 is seated against the outer stack of springs 126, similar to what was done with the inner stack of springs. Male threaded fasteners 134 are then utilized to retain the ring 157 and springs 126 to support member 164, similar to how the inner flexure bearing assembly was mounted. A washer-shaped spacer 172 is then received over shaft 104, after which nut 154 is threaded onto shaft 104 and tightened in order to rigidly retain all of the members mounted between shoulder 146 and nut 154. Finally, end plate 142, including end cap 140 is mounted to housing 72 where it is welded in sealed engagement there along.

B. Displacer Assembly

FIG. 5 illustrates a construction of displacer assembly 62 that enables realization of an accurate and precise clearance seal 81 without having to resort to a costly and difficult construction. Namely, end plate 85 has mounting features that enable realization of clearance seal 81 during assembly to housing 86. Hence, displacer assembly 62 can be pre-assembled to achieve clearance seal 81 prior to final assembly to linear drive motor assembly 64 (See FIG. 4). Therefore, displacer 79 does not have to be critically aligned with piston 36 (See FIG. 4) during assembly. This allows for elimination of critical tolerance requirements when assembling together displacer assembly 62 and motor assembly 64 (See FIG. 4).

Housing 86 is constructed by assembling together a central mounting member 180, an end collar 182, an outer end tube 184, and cold head 78. To secure them together, tube 184 is brazed at each end to end collar 182 and cold head 78, respectively. Subsequently, collar 182 is welded to member 180. The assembled housing 86 then receives displacer 79 and associated supporting components inside chamber 97, formed therein, after which end plate 85 is mated in assembly to housing 86.

To facilitate construction, member 180 is machined from a single piece of aluminum. Mating portion 100 extends from an open mouth 186 to a circumferential shoulder 188. Shoulder 188 seats against an open end of motor housing 72, adjacent to where cavity 98 (of FIG. 4) terminates to receive housing 86. Member 180 has a decreased diameter portion along heat rejection region 84 configured to receive a water jacket 190 there along. Water jacket 190 is formed from thin wall stainless steel sheet metal construction, having a flow inlet 192 and a flow outlet 194 for delivering cooling fluid therethrough during operation of cooler 60. Jacket 190 enhances thermodynamic efficiency of the cooler by rejecting heat from heat rejection region 84. In this manner, heat transference of working fluid passing through cylindrical path 82 is enhanced. Alternatively, an array of cooling fins can be used in place of jacket 190.

End collar 182 is depicted in FIG. 5 as a single-piece construction. To facilitate welding of collar 182 to member 180 (which is aluminum) and tube 184 (which is stainless steel), collar 182 is formed by joining together two separate pieces of material. Here, a piece of aluminum and a piece of stainless steel are joined together. By forming collar 182 from two dissimilar metals, the collar can be brazed to aluminum member 180 and stainless steel tube 184 at opposite ends, with matching metal. A radially-outwardly extending flange portion of collar 182 adjacent to member 180 is formed from aluminum. A cylindrical portion adjacent to tube 184 is formed from stainless steel. The two pieces are explosive bonded together with a thin piece of washer-shaped copper that is sandwiched there between. Alternatively, the two pieces can be brazed together. A circumferential recess 196 is configured along a radial innermost surface of collar 182 adjacent one end to receive and support tube 184 therein. Tube 184 is then brazed, or welded circumferentially thereabout. For this construction, tube 184 has a typical wall thickness in the range of 4 to 8 one-thousandths of an inch.

To minimize corrosion, cold head 78 of FIG. 5 is formed from a block of stainless steel. A circumferential recess 198 is formed along a radial outermost surface of head 78, adjacent to tube 184 to facilitate mounting of head 78. Recess 198 is received within an outer end portion of tube 184, after which the tube and head are brazed together circumferentially there along. Alternatively, the head and tube can be welded together.

As shown in FIG. 5, end plate 85 is provided with a plurality of oversized through holes 200 around its outer periphery to enable mounting of plate 85 to housing 86. A complementary corresponding plurality of threaded bores 204 are also provided along open mouth 186 of housing 86 for receiving threaded fastener 202 therein. In this manner, a fastener 202 is received through each hole 200 and threaded into each bore 204. Holes 204 are purposely oversized in order to enable coaxial alignment of bore 83 with respect to an end collar, or shim 208 during fastening. Collar 208 is fitted onto displacer rod 90, and cooperates to form drive area 92 there between. Collar 208 forms a drive area end portion on displacer rod 90 that extends through bore 83. Coaxial alignment there along ensures realization of clearance seal 81 therebetween.

Preferably, end collar 208 is press-fit and bonded with an anaerobic epoxy to reduced diameter end portion 212 of rod 90. End collar 208 is formed from a piece of stainless steel material. Alternatively, end collar 208 can be formed from a piece of Teflon™, a registered trademark of E.I. DuPont De Nemours and Co., of Wilmington, Del. or Delrin™ a registered trademark of E.I. DuPont De Nemours and Co., of Wilmington, Del. End collar 208 is fitted onto rod 90 as a separate piece in order to enable formation of threads 214 on an immediately adjacent portion of rod 90. Furthermore, end collar 208 allows for easy tailoring of piston surface area presented by drive area 92 in communication with the compression chamber 66. It is desirable to tailor the surface area when tuning the dynamic response of the entire displacer system. By increasing surface area presented by drive area 92 relative to the overall spring constant of the system and the accompanying moving mass, the dynamic response of the system due to compression pulses applied in working chamber 66 can be optimized. Hence a tuned and synchronized reciprocation of displacer 79 within housing 86 and relative to working piston 76 can be produced therein.

As shown in FIG. 5, displacer 79 is formed by joining together displacer rod 90, an inner end tube 210, and end cap 87. Tube 210 is formed from a thin walled piece of stainless steel tubing having a wall thickness of from approximately 4 to 8 one thousandths of an inch. A plurality of disks 213 are also stacked within tube 210, providing regenerator 80 therein. Disks 213 are formed from cut-out portions of wire screen having a capacity for rapidly transferring and storing heat. Alternatively, random fibers or wires can be packed therein, having only limited adjoining contact between adjacent pieces. One construction utilizes disks 213 formed from stainless steel screen. Alternatively, copper or plastic material can be utilized to form disks 213 or packed fibers. Irrespective of which construction is utilized, the ideal construction will have a capacity for transferring and storing heat, but will also have poor longitudinal and lateral conduction there through.

Displacer rod 90 of FIG. 5 has reduced diameter end portion 212 configured to receive end collar 208 there along. Threaded portion 214 is provided adjacent to end portion 212, along rod 90. A flexure seat portion 216 extends substantially along rod 90, terminating at a shoulder portion 217. An enlarged diameter portion 219 is formed in rod 90 within a bore portion 221 of chamber 97. Bore 221 and portion 219 cooperate to define a clearance seal 223 therebetween.

A reduced diameter central portion 218 is also formed adjacent portion 219, thereby defining the circumferential innermost surface of cylindrical path 82. In this manner, circumferential path 82 extends along an outer peripheral surface of rod 90, along central portion 218. A plurality of radially extending bores 220 are formed in rod 90, allowing fluid communication between fluid flow path 68, centrally of rod 90 and cylindrical flow path 82 along the radial outer peripheral surface of the rod. Similarly, a plurality of radially extending bores 222 are formed in rod 90 at an opposite end of central portion 218, enabling fluid communication with a remaining portion of fluid flow path 68 adjacent to, and in contiguous fluid communication with displacer 80.

Additionally, a radially enlarged end 224 is formed by rod 90 having a circumferential recess 226 configured to receive inner end tube 210, in assembly. Recess 226 is formed along a radial outermost portion of end 224, having a diameter configured to receive an end portion of tube 210 there over in assembly.

Displacer 79 is formed by joining together displacer rod 90 to inner end tube 210 and end cap 87, as shown in FIG. 5. Tube 210 is received over circumferential recess 226 where it is brazed or welded. Similarly, cap 87 has a corresponding circumferential recess 228 received within an opposite end of tube 210 where it is also brazed or welded. Tube 210 is brazed to rod 90 and cap 87 at opposite ends, respectively, after which the resulting displacer 79 is mounted to a lathe where it is machined to insure concentric alignment of tube 210 and cap 87 onto rod 90. Concentricity is required in order to insure provision of a clearance seal 225 between tubes 184 and 210, as well as end 224 and collar 182. When assembled together, end 224 and tube 210 form clearance seal 225 inside chamber 97.

End cap 87 of FIG. 5 has a central bore 230 that communicates in assembly with the inside of inner tube 210; namely, within regenerator 80. A plurality of radially extending bores 232 are also provided in fluid communication with bore 230 and circumferential cavity 88, exiting along an outer surface 234 there around. Cavity 88 is in direct fluid communication with expansion chamber 70. Furthermore, expansion area 94 on displacer 38 is defined by the outermost end of cap 87.

Flexure bearing assemblies 95 are used to mount displacer 79 within housing 86, in a manner that helps to ensure realization of close fit clearance seals 81, 223, and 225 therein. Flexure bearing assemblies 95 are similar to assemblies 106 of motor assembly 64. Each assembly 95 is formed from a plurality of flat spiral springs 126, configured as depicted and described in FIG. 6 below. However, springs 126 for use in assembly 95 are sized with a smaller diameter than springs used in assembly 106. A suitable spring has a diameter of 1 3/16 inches. Other than diameter, both springs are substantially identical in configuration. For purposes of later discussion relating to FIG. 6, and for purposes herein, reference numerals for springs 106 will be identical when referring to either assembly 95 or 126 (See FIG. 4).

In order to retain displacer 79 within housing 86, a plurality of elongate fasteners 236 are threaded into bores 238 in member 180. A fastener is passed through each receiving hole 132 formed along outer periphery 130 of each flat spiral spring 126. A similar construction is used to assemble the flexure bearing assemblies within the motor assembly. First, the fully assembled displacer 79 is inserted within chamber 97, formed inside housing 86. Subsequently, a plurality of springs 126 are loaded onto displacer rod 90 by passing them over end collar 208 through their corresponding through holes 128. The stack of springs 126 are brought into engagement with shoulder 217, after which a cylindrical spacer 242 is passed over portion 216 of rod 90 until it engages with the opposed face of the stack of springs 126. Then, a cylindrical retainer 240 is inserted within chamber 97 where it is brought into engagement with the outer periphery 130 of the stack of springs 126. Retainer 240 has a plurality of through holes 241, each configured to receive a fastener 236 in final assembly, with each received fastener extending through holes 132 in each spring 126 and into threaded bore 238.

Subsequently, a second, or outer flexure bearing assembly 95 is loaded into chamber 97, engaging with cylindrical spacer 242 and cylindrical retainer 240. Essentially, a stack of springs is loaded onto rod 90, passing them over end collar 208 until they engage with the end of spacer 242 and retainer 240. A typical construction would use six springs in each assembly 95. Subsequently, a retaining ring 244 is loaded into engagement with a back side of the assembly 95. Then, each of fasteners 236 is passed through ring 244, assemblies 95, and retainer 240 where they are threadingly engaged within each of bores 238. In this manner, both flexure bearing assemblies 95 are securely retained along their outer peripheries to housing 86.

In order to securely retain displacer 79 to the secured assemblies 95, a washer 246 is loaded onto rod 90, engaging with the outer most assembly 95. Subsequently, a nut 248 is threaded onto rod 90 along threaded portion 214. Nut 248 is tightened onto rod 90, trapping the innermost assembly 95 between shoulder 217 and an inner end of tube 242, and trapping the outermost assembly 95 between an outermost end of tube 242 and washer 246. In this manner, displacer 79 is rigidly secured along the inner region of each spring 126 for accurate axial reciprocation within chamber 97 of housing 86.

Finally, end plate 85 is precisely positioned and fastened such that bore 83 is concentric with the outer surface of end collar 208. In this manner, clearance seal 81 can be made to have a very thin gap, reducing working fluid leakage while eliminating contact friction there between. Preferably, a 0.001 inch clearance seal is achieved, and a shim of nominally smaller size is place between bore 83 and the collar 208 of the displacer. While the shim is in place, end plate 85 is secured into position with fasteners 202, capturing concentricity there between. Hence, control of dimensional variations in components is not required to realize a clearance seal with a very thin gap, thereby greatly reducing manufacturing costs.

FIG. 6 depicts a typical cross-sectional configuration of a stamped steel spring 126 as used in the fully assembled cooler 60. Springs 126 are of similar construction to those utilized in assemblies 106 of motor assembly 64, except the diameter has been decreased. One suitable construction for spring 126 when used to support displacer 79 consists of a flat piece of spring steel having a diameter of 1 3/16 inches, a thickness of 0.02 inches, and a plurality of spiral kerfs 252 formed therein for facilitating accurate axial movement there along. Such a construction is detailed in applicants' co-pending U.S. patent application Ser. No. 08/105,156, previously incorporated by reference.

The construction of FIG. 6 allows for passage of rod 90 within through hole 128 until spring 126 seats against shoulder 217. Similarly, outer periphery 130 seats on a shelf 250 within member 180. Eight equally spaced-apart through holes 128 are formed in outer periphery 130. Each through hole 128 receives an elongate fastener 236 there through in final assembly. Various alternative configurations for curves 252 can be envisioned which will provide for precise axial reciprocation of rod 90 within housing member 180.

Further improvements in the form of enhanced fatigue life have been found when the surfaces of flexure spring 126 are grit blasted. Particularly, grit blasting of the edges of kerfs 252 has improved fatigue life, especially along high stress areas. Alternatively, electro-chemical polishing or other surface enhancement processes that impart a compressive stress to the outer surface of spring 126, reduce (or eliminate) small surface imperfections, and/or radius the edges of stressed surfaces while provide similar improvements to fatigue life. One suitable preparation used a 60–100 US Sieve (size AC) grit applied at 80 to 100 psig through a standard grit blast nozzle of 0.125 inch diameter. The prepared spring had about a 1.5 to 1.75 times increase in stress or stroke before failure (compared with a spring having a nonprepared surface).

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A displacer assembly configured to be movably supported within a chamber in a housing of a thermal regenerative machine, comprising:

a body at least in part providing a displacer, the body configured to be movably supported within the chamber, the body having a displacer rod formed by the body, a drive surface formed by an end of the displacer rod, and an expansion surface formed by the body;

at least one flexure bearing assembly constructed and arranged to carry the displacer for reciprocation within a chamber in a housing of a thermal regenerative machine; and a fluid flow path provided by the displacer rod extending between the drive surface and the expansion surface and being configured to shuttle working fluid between a compression chamber and an expansion chamber when assembled in the housing, the fluid flow path extending in part along a central portion of the rod and in part along an outer peripheral surface of the rod adjacent a heat exchanger region of the housing.

2. A displacer assembly for use in a thermal regenerative machine, comprising:

a displacer;

a housing having first and second members configured to mate in concentrically positionable engagement to form a housing chamber therein for housing a gaseous working fluid;

a mount for slidably receiving and supporting the displacer on one of the members and within the housing;

a cylinder bore provided on the other of the members, configured to slidably receive the displacer rod, and sized to form a clearance seal therebetween in assembly; and at least one fastener configured for adjustably retaining the first and the second members together to enable adjustable positioning during assembly of the cylinder bore concentrically about the displacer rod such that the clearance seal is realized therebetween.

3. In a thermal regenerative machine, such as a Stirling cycle cryogenic cooler, a displacer assembly comprising:

a housing having an outer mating portion, a housing chamber for housing a gaseous working fluid therein, and a clearance seal bore provided through the outer mating portion, the clearance seal bore extending between the housing chamber and the outer mating portion, the outer mating portion constructed and arranged to mate in assembly with a compression chamber of a linear drive motor having a driving piston which acts on the working fluid in a thermodynamic refrigeration cycle to cool a portion of the working fluid;

a displacer having a displacer rod, a drive area, and an expansion area, the displacer being supported within the housing chamber for axial reciprocation, the drive area being in fluid communication with the compression chamber and the expansion area being in fluid communication with an expansion chamber, the expansion chamber being formed between a portion of the housing chamber and the expansion area;

a fluid flow path provided by the displacer assembly, defined at least in part by the housing and the displacer, and extending in assembly between the compression chamber and the expansion chamber, the displacer being movable within the housing chamber responsive to pressure variations in working fluid from action of the driving piston to shuttle working fluid between the compression chamber and the expansion chamber via the fluid flow path; and a clearance seal formed between the clearance seal bore of the housing and a drive area end portion of the displacer rod, the clearance seal bore of the housing constructed and arranged to slidably receive the drive area end portion of the displacer rod;

wherein provision of the clearance seal bore in the housing of the displacer assembly eliminates any need for concentricity between the drive piston of the linear drive motor and the displacer of the displacer assembly in order to realize a clearance seal therebetween when mated together in assembly.

4. The displacer assembly of claim 3 wherein at least a portion of the compression piston of the displacer rod comprises a tubular collar carried by the displacer rod concentrically within the clearance seal bore.

5. The displacer assembly of claim 3 wherein the fluid flow path is provided by the displacer rod, the flow path extending in part along a central portion of the rod and in part along an outer peripheral surface of the rod adjacent a heat rejection region of the housing.

6. The displacer assembly of claim 5 wherein one part of the flow path central portion is in direct fluid communication with the compression chamber.

7. The displacer assembly of claim 5 wherein the fluid flow path further comprises at least one outwardly extending flow port communicating between the flow path along the central portion of the rod and the flow path along the outer peripheral surface of the rod.

8. The displacer assembly of claim 5 wherein the heat rejection region comprises a cold head.

9. The displacer assembly of claim 5 wherein the heat rejection region comprises a cooling water jacket provided along an intermediate portion of the housing.

10. The displacer assembly of claim 5 wherein the displacer further comprises a regenerator interposed between the compression piston and the expansion piston, the regenerator being provided in the fluid flow path, and the regenerator being operative for regenerative heat transference there along.

11. The displacer assembly of claim 3 wherein the housing comprises a first chamber forming member and a second chamber forming member, the first and second chamber forming members constructed and arranged to mate in sealing engagement therebetween in assembly to provide the housing chamber therein.

12. The displacer assembly of claim 3 wherein the housing mating portion comprises a male end portion and the linear drive motor comprises a complementary corresponding female receiving bore, the male end portion of the housing being sized to be received in assembly within the female receiving bore of the linear drive motor.

13. The displacer assembly of claim 3 further comprising an internally mounted flexure bearing assembly constructed and arranged to support the displacer within the housing chamber.

14. The displacer assembly of claim 13 wherein the flexure bearing assembly comprises at least one flat spiral spring fixed at its center to the displacer rod and fixed about its outer periphery to chamber structure of the housing.

15. The displacer assembly of claim 14 having at least two axially spaced apart stacks of flat springs.

16. In a thermal regenerative machine, such as a Stirling cycle cryogenic cooler, a displacer assembly comprising:

a housing having a housing chamber therein for housing a gaseous working fluid, the housing constructed and arranged to mate in assembly with a working fluid motor, the housing and working fluid motor cooperating in assembly to define a compression chamber therebetween; and a displacer having a displacer rod and a regenerator, the displacer being supported within the housing chamber for axial reciprocation, a portion of the displacer providing a drive area in fluid communication with the compression chamber and an expansion area in fluid communication with an expansion chamber enclosed within the housing; and a fluid flow path provided in the displacer rod extending in fluid communication between the compression chamber and the expansion chamber, in assembly the compression chamber, the expansion chamber, and the fluid flow path cooperating to house the gaseous working fluid, the fluid flow path extending in part along a central portion of the displacer rod for through passage of the regenerator to facilitate heat regeneration therein adjacent the expansion chamber and in part along an outer peripheral surface of the displacer rod adjacent a heat rejection region of the housing, and the displacer constructed and arranged when in assembly with a working fluid motor to transfer a working fluid within the housing chamber between the compression chamber and the expansion chamber via the fluid flow path when moving between extended and retracted positions in response to pressure variations in the working fluid imparted from a working fluid motor;

wherein the transferred working fluid in the housing chamber is alternately compressed and expanded in a thermodynamic cycle to cool a portion of the working fluid within the expansion chamber of the housing chamber.

17. The displacer assembly of claim 16 wherein the fluid flow path further comprises at least one outwardly extending flow port communicating between the flow path along the central portion of the rod and the flow path along the outer peripheral surface of the rod.

18. The displacer assembly of claim 16 wherein the heat rejection region comprises a cold head.

19. The displacer assembly of claim 16 wherein the heat rejection region comprises a cooling water jacket provided along an intermediate portion of the housing.

20. The displacer assembly of claim 16 further comprising a working fluid motor having a housing, a compressor carried by the housing, and a bore provided in the housing, the compressor constructed and arranged to produce working fluid pressure pulses within the compression chamber, the bore being constructed and arranged to receive therein an end portion of the displacer assembly, and the displacer assembly having a housing portion constructed and arranged in assembly to be received in the bore.

21. The displacer assembly of claim 20 wherein the working fluid motor is a linear drive motor having a driving piston movable in fluid communication with the compression chamber for axial reciprocation within the motor housing.

22. The displacer assembly of claim 16 further comprising an internally mounted flexure bearing assembly constructed and arranged to mount the displacer within the housing chamber for axial reciprocation therein.

23. The displacer assembly of claim 22 wherein the flexure bearing assembly comprises at least on flat spiral spring fixed at its center to the displacer rod and fixed about its outer periphery to the chamber structure of the housing.

24. The displacer assembly of claim 23 having at least two axially spaced apart stacks of flat springs.

25. The displacer assembly of claim 16 wherein a portion of the fluid flow path extends along the central portion of the displacer rod in direct fluid communication with the compression chamber, another portion extends along the outer peripheral surface along the heat rejection region, and yet another portion extends along the central portion adjacent the expansion chamber.

26. The displacer assembly of claim 25 wherein the fluid flow path includes at least one flow passage extending in fluid communication between the fluid flow path along the central portion of the rod and the fluid flow path along the outer peripheral surface of the rod.

27. The displacer assembly of claim 16 wherein the housing comprises a pressure vessel, an end plate, and a retainer for mating the end plate in engagement with the pressure vessel, the pressure vessel configured to receive the displacer in a bore, and a mouth end portion of the pressure vessel constructed and arranged to mate in sealing engagement with the end plate to provide the housing chamber therebetween, the end plate having a clearance seal bore extending therethrough for receiving a drive area end portion of the displacer rod, in assembly, the bore and rod end portion sized to provide a clearance seal therebetween, with the end plate being laterally positionable during assembly with the pressure vessel to precisely align the displacer rod for concentricity with the end plate bore, the retainer operable to retain the end plate in such position.

28. The displacer assembly of claim 27 wherein at least part of the rod end portion of the displacer rod comprises a tubular collar carried by the displacer rod.

29. In a thermal regenerative machine, such as a Stirling cycle cryogenic cooler, a displacer assembly comprising:

a housing having a chamber forming member with an open mouth, an end plate configured to adjustably mate in sealing engagement with the mouth, a housing chamber formed between the member and the end plate for housing a gaseous working fluid therein, a clearance seal bore provided through the end plate, and an outer mating portion provided by the housing, the outer mating portion constructed and arranged to mate in assembly with a compression chamber of a linear drive motor having a driving piston which acts on the working fluid in a thermodynamic refrigeration cycle to cool a portion of the working fluid; and a displacer having a displacer rod, a drive area formed from an end of the rod, and an expansion area, the displacer being slidably received within the housing chamber for axial reciprocation, the drive area being in fluid communication with the compression chamber and the expansion area being in fluid communication with an expansion chamber, the expansion chamber formed from a portion of the housing chamber and bounded by the expansion area and the housing, a fluid flow path provided by the displacer assembly extending between the compression chamber and the expansion chamber, the displacer being movable within the chamber to shuttle working fluid between the compression chamber and the expansion chamber, the clearance seal bore of the housing constructed and arranged to slidably receive the drive area end portion of the displacer rod and sized to form a clearance seal therebetween;

wherein provision of the clearance seal bore in the end plate in combination with adjustable mating of the end plate to the chamber forming member imparts concentricity between the clearance seal bore and the drive area end portion of the displacer rod when mated together in assembly.

30. The displacer assembly of claim 29 wherein at least a penetrating end portion of the drive area end of the displacer rod comprises a tubular collar carried by the displacer rod.

31. The displacer assembly of claim 29 further comprising a fluid flow path provided by the displacer assembly extending between the compression chamber and the expansion chamber, the displacer being movable within the chamber to shuttle working fluid between the compression chamber and the expansion chamber, the clearance seal bore of the housing constructed and arranged to slidably receive the drive area end portion of the displacer rod and sized to form a clearance seal therebetween.

32. The displacer assembly of claim 31 wherein the fluid flow path is provided by the displacer rod, the flow path extends in part along a central portion of the rod and in part along an outer peripheral surface of the rod adjacent a heat rejection region of the housing.

33. The displacer assembly of claim 32 wherein one part of the flow path central portion originates from the drive area end portion of the displacer rod.

34. The displacer assembly of claim 29 further comprising an internally mounted flexure bearing assembly constructed and arranged to mount the displacer within the housing chamber.

35. The displacer assembly of claim 34 wherein the flexure bearing assembly comprises at least one flat spiral spring fixed at its center to the displacer rod and fixed about its periphery to chamber structure of the housing.

36. The displacer assembly of claim 35 having at least two axially spaced apart stacks of flat springs.

37. In a thermal regenerative machine, such as a Stirling cycle cryogenic cooler, a displacer assembly comprising:

a housing having a chamber forming member with an open mouth, an end plate configured to mate in sealing engagement with the mouth, a housing chamber formed between the member and the end plate for housing a gaseous working fluid therein, a clearance seal bore provided through the end plate, and an outer mating portion provided by the housing, the mating portion constructed and arranged to mate in assembly with a compression chamber of a linear drive motor having a driving piston which acts on the working fluid in a thermodynamic refrigeration cycle to cool a portion of the working fluid; and a displacer having a displacer rod, a drive area formed from an end of the rod, and an expansion area, the displacer being slidably received within the housing chamber for axial reciprocation, the drive area being in fluid communication with the compression chamber and the expansion area being in fluid communication with an expansion chamber, the expansion chamber formed from a portion of the housing chamber and bounded by the expansion area and the housing, a fluid flow path provided by the displacer assembly extending between the compression chamber and the expansion chamber, the displacer being movable within the chamber to shuttle working fluid between the compression chamber and the expansion chamber, the clearance seal bore of the housing constructed and arranged to slidably receive the drive area end portion of the displacer rod and sized to form a clearance seal therebetween, and wherein at least a penetrating end portion of the drive area end of the displacer rod comprises a tubular collar carried by the displacer rod;

wherein provision of the clearance seal bore in the end plate eliminates any requirement for concentricity between the drive piston of the linear drive motor and the drive area end portion of the displacer rod otherwise necessary to realize a clearance seal therebetween when mated together in assembly.

38. In a thermal regenerative machine, such as a Stirling cycle cryogenic cooler, a displacer assembly comprising:

a housing having a chamber forming member with an open mouth, an end plate configured to mate in sealing engagement with the mouth, a housing chamber formed between the member and the end plate for housing a gaseous working fluid therein, a clearance seal bore provided through the end plate, and an outer mating portion provided by the housing, the mating portion constructed and arranged to mate in assembly with a compression chamber of a linear drive motor having a driving piston which acts on the working fluid in a thermodynamic refrigeration cycle to cool a portion of the working fluid; and a displacer having a displacer rod, a drive area formed from an end of the rod, and an expansion area, the displacer being slidably received within the housing chamber for axial reciprocation, the drive area being in fluid communication with the compression chamber and the expansion area being in fluid communication with an expansion chamber, the expansion chamber formed from a portion of the housing chamber and bounded by the expansion area and the housing, a fluid flow path provided by the displacer assembly extending between the compression chamber and the expansion chamber, the displacer being movable within the chamber to shuttle working fluid between the compression chamber and the expansion chamber, the clearance seal bore of the housing constructed and arranged to slidably receive the drive area end portion of the displacer rod and sized to form a clearance seal therebetween; and a fluid flow path provided by the displacer assembly extending between the compression chamber and the expansion chamber, the displacer being movable within the chamber to shuttle working fluid between the compression chamber and the expansion chamber, the clearance seal bore of the housing constructed and arranged to slidably receive the drive area end portion of the displacer rod and sized to form a clearance seal therebetween, wherein the fluid flow path is provided by the displacer rod, the flow path extends in part along a central portion of the rod and in part along an outer peripheral surface of the rod adjacent a heat rejection region of the housing;

wherein provision of the clearance seal bore in the end plate eliminates any requirement for concentricity between the drive piston of the linear drive motor and the drive area end portion of the displacer rod otherwise necessary to realize a clearance seal therebetween when mated together in assembly.

39. In a thermal regenerative machine, such as a Stirling cycle cryogenic cooler, a displacer assembly comprising:

a housing having a chamber forming member with an open mouth, an end plate configured to mate in sealing engagement with the mouth, a housing chamber formed between the member and the end plate for housing a gaseous working fluid therein, a clearance seal bore provided through the end plate, and an outer mating portion provided by the housing, the mating portion constructed and arranged to mate in assembly with a compression chamber of a linear drive motor having a driving piston which acts on the working fluid in a thermodynamic refrigeration cycle to cool a portion of the working fluid; and a displacer having a displacer rod, a drive area formed from an end of the rod, and an expansion area, the displacer being slidably received within the housing chamber for axial reciprocation, the drive area being in fluid communication with the compression chamber and the expansion area being in fluid communication with an expansion chamber, the expansion chamber formed from a portion of the housing chamber and bounded by the expansion area and the housing, a fluid flow path provided by the displacer assembly extending between the compression chamber and the expansion chamber, the displacer being movable within the chamber to shuttle working fluid between the compression chamber and the expansion chamber, the clearance seal bore of the housing constructed and arranged to slidably receive the drive area end portion of the displacer rod and sized to form a clearance seal therebetween; and at least one flexure bearing assembly constructed and arranged to mount the displacer within the housing chamber;

wherein provision of the clearance seal bore in the end plate eliminates any requirement for concentricity between the drive piston of the linear drive motor and the drive area end portion of the displacer rod otherwise necessary to realize a clearance seal therebetween when mated together in assembly.

* * * * *